US006092249A

United States Patent [19]

Kamen et al.

[11] Patent Number: 6,092,249

[45] Date of Patent: Jul. 25, 2000

[54] CONSTANT PRESSURE SEATING SYSTEM

[75] Inventors: Dean L. Kamen, Bedford, N.H.; Charles M. Grinnell, Groton, Mass.; Michael T. Bush, South Portland, Me.; Gustavo Y. Buhacoff, Portland, Oreg.

[73] Assignee: DEKA Products Limited Partnership, Manchester, N.H.

[21] Appl. No.: 08/863,674

[22] Filed: May 27, 1997

Related U.S. Application Data

[60] Provisional application No. 60/018,446, May 28, 1996, abandoned, and provisional application No. 60/018,776, May 31, 1996, abandoned.

[51] Int. Cl.[7] ..... A47C 27/10; A61G 7/057

[52] U.S. Cl. ..... 5/653; 5/654; 5/655.9; 5/709; 5/713; 297/284.3

[58] Field of Search ..... 5/709, 710, 713, 5/653, 654, 655.9, 731, 736, 740, 900.5, 901, 722, 723, 727; 297/284.2, 284.3, 284.6

[56] References Cited

U.S. PATENT DOCUMENTS

| | | | |
|---|---|---|---|
| 2,751,609 | 6/1956 | Oesterling et al. | 5/900.5 |
| 3,293,671 | 12/1966 | Griffin | 5/900.5 |
| 3,297,023 | 1/1967 | Foley . | |
| 3,564,628 | 2/1971 | Oxford | 5/709 X |
| 3,595,223 | 7/1971 | Castagna | 128/33 |
| 3,613,671 | 10/1971 | Poor et al. | 128/24 R |
| 3,730,588 | 5/1973 | Braun | 297/284 |
| 3,770,315 | 11/1973 | Smittle et al. | 297/284 |
| 3,828,378 | 8/1974 | Flam | 5/730 |
| 3,879,776 | 4/1975 | Solen | 5/350 |
| 3,919,730 | 11/1975 | Regan | 5/348 R |
| 4,005,236 | 1/1977 | Graebe | 428/72 |
| 4,175,297 | 11/1979 | Robbins et al. | 5/284 |
| 4,371,997 | 2/1983 | Mattson | 5/654 |
| 4,524,762 | 6/1985 | Schulman | 128/33 |
| 4,541,136 | 9/1985 | Graebe | 5/456 |
| 4,555,140 | 11/1985 | Nemoto | 297/452 |
| 4,628,557 | 12/1986 | Murphy | 5/723 |
| 4,688,283 | 8/1987 | Jacobson et al. | 5/449 |
| 4,698,864 | 10/1987 | Graebe | 5/441 |
| 4,713,854 | 12/1987 | Graebe | 5/481 |
| 4,788,730 | 12/1988 | Bexton | 5/723 |
| 4,799,276 | 1/1989 | Kadish | 5/446 |
| 4,852,195 | 8/1989 | Schulman | 5/453 |
| 4,947,500 | 8/1990 | Seiler | 5/453 |
| 4,951,335 | 8/1990 | Eady | 5/450 |
| 4,995,124 | 2/1991 | Wridge, Jr. et al. | 5/450 |
| 5,029,939 | 7/1991 | Smith et al. | 297/284 |
| 5,033,133 | 7/1991 | Nissen | 5/709 |
| 5,068,504 | 11/1991 | Rogers | 200/85 R |
| 5,079,790 | 1/1992 | Pouch | 5/431 |
| 5,142,717 | 9/1992 | Everard et al. | 5/450 |
| 5,144,705 | 9/1992 | Rogers | 5/453 |
| 5,159,726 | 11/1992 | Bloch et al. | 5/453 |
| 5,163,737 | 11/1992 | Navach et al. | 297/459 |
| 5,259,080 | 11/1993 | Blaha | 5/740 |
| 5,325,551 | 7/1994 | Tappel et al. | 5/453 |
| 5,360,653 | 11/1994 | Ackley | 5/740 |
| 5,379,471 | 1/1995 | Holdredge | 5/456 |
| 5,442,823 | 8/1995 | Siekman et al. | 5/653 |
| 5,459,896 | 10/1995 | Raburn et al. | 5/653 |
| 5,500,965 | 3/1996 | Hannagan et al. | 5/654 |
| 5,513,402 | 5/1996 | Schwartz | 5/727 |
| 5,558,314 | 9/1996 | Weinstein | 267/91 |
| 5,568,660 | 10/1996 | Raburn et al. | 5/652.1 |

FOREIGN PATENT DOCUMENTS

| | | |
|---|---|---|
| 0200822A1 | 11/1986 | European Pat. Off. . |
| 3303615A | 8/1984 | Germany . |
| 8814506 U | 3/1989 | Germany . |
| WO96/22478A | 7/1996 | WIPO . |

*Primary Examiner*—Michael F. Trettel
*Attorney, Agent, or Firm*—Bromberg & Sunstein LLP

[57] ABSTRACT

A cushion system for supporting a body such as a seated person at risk of developing pressure sores. An array of one or more foam members is biased such that each foam member exhibits a substantially constant force per unit area when supporting the body. The bias may be passive, by choice of foam characteristics, and additionally, may be applied actively by providing a gas to the foam and controlling the pressure of the gas in response to the pressure conditions at the interface with the supported body.

32 Claims, 13 Drawing Sheets

MODULAR CUSHION SCHEMATIC
SINGLE ALTERNATING BUSS

MODULAR CUSHION SCHEMATIC
DUAL BUSS

CONSTANT PRESSURE SEATING SYSTEM

RELATED APPLICATION

The present application claims priority from U.S. provisional application number 60/018,446, filed May 28, 1996, now expired, and from U.S. provisional application number 60/018,776, filed May 31, 1996, now expired, which are herein incorporated by reference.

TECHNICAL FIELD

The present invention pertains to a seating cushion particularly suited for the minimization of interface pressures and the prevention of pressure sores in a seated person.

BACKGROUND

Pressure sores are a major concern for wheelchair users; should the user get a sore, it can result in significant medical costs, a period of enforced bed rest, infection, and ultimately death. It is estimated that the average cost today of treating a pressure sore is on the order of $15,000. Also, various studies have attributed about 5% of the deaths of paraplegics and quadriplegic to complications from pressure sores.

Careful distribution and periodic relief of the pressure on a seated person at the seat interface is important for prevention of pressure sores. In an able-bodied person, moving in and out or around one's chair is a principal mechanism for accomplishing this. For para/quadriplegic and other persons at risk for pressure sores such as the elderly or persons with cerebral palsy multiple sclerosis, or muscular degenerative diseases generally, this may not be an option. Strategies commonly adopted for prevention of pressure sores in susceptible individuals may be categorized generally as passive and active.

Passive seat cushions distribute the load more optimally across the buttocks of the seated individual. These cushions are employed to transfer load from the higher risk areas of the buttocks, namely tissue overlying bony prominence such as the ischials, the coccyx, the sacrum, and the trochanters, onto lower risk areas such as the posterior thighs. Passive seat cushions include air flotation types, gel types, combination air/foam cushions, honeycombs, as well as simple blocks of foam. The term "foam," as used in this specification and in the appended claims, refers to a class of materials consisting of included voids (or "cells") filled with air or another fluid within the matrix of a solid, which materials exhibit some degree of resilience in that they recover some or all of their initial volume following compression and release.

For individuals at high risk of developing pressure sores, or individuals who are unable to redistribute their weight periodically on a seat, a passive seat cushion is generally not adequate to eliminate the risk. In this case, it is generally recommended to supplement the passive cushion with a tilt and/or recline seating system, or, otherwise, an attendant may assist with manual pressure relief. A tilt and/or recline method, whether powered or manual, typically lays the user onto his or her back while attendant assisted pressure relief typically involves lifting the user and repositioning the user in the chair.

A further possibility for individuals at high risk is an active seat cushion that employs pneumatic or mechanical means to cyclically relieve pressure under some portion of the anatomy. Such devices generally use positive air pressure to inflate some portion of the cushion, and, by increasing pressure in the inflated area, raise the user and decrease the interface pressure in those portions of the seat which are not inflated. The term "interface pressure," as used in this description and in the appended claims, refers to the force per unit area exerted by the weight of the seated person on the cushion material, and the equal and opposing force per unit area exerted by the cushion on the seated person's body.

1. Foam Characteristics and Pads for Seating

Foams, as defined above, are discussed in further detail in L. Gibson, *Cellular Solids: Structures and Properties* (Pergamon Press, 1988), which is herein incorporated by reference. The cells of a foam are, furthermore, distinguished as "open" or "closed" with respect to the flow of air into, or out of, the respective cells.

Foams are conventionally characterized in terms of "stiffness," a measure which indicates, on the basis of a standard measurement technique, how much force per unit area is required to cause a specified indentation of the middle of a test block of material in bulk. For example, the Indentation Load Deflection (ILD), specified by ASTM Standard Test D-3574-81, specifies the load causing a 25% indentation of the material.

The use of a single stiffness measure is deficient in two important respects that are relevant to the present invention. On the one hand, the single stiffness measure fails to distinguish among characteristics of the functional dependence of pressure on the displacement of the foam, in which various regimes may be discerned, as discussed in detail in the description below. Moreover, the single stiffness measure is limited to characterization of the material in bulk and does not account for the structural configuration in which the material is used. Thus, while the behavior of a bulk configuration of material may be dominated by its compression, tall columns of material, much taller than the characteristic transverse material dimension, will be dominated by buckling, or columnar collapse, of the entire column. In a third regime, so-called "short columns" exhibit material properties intermediate between those of the bulk and columnar limits. The relevant structural parameter is thus the aspect ratio of the column, namely, the ratio of the height of material normal to the surface of contact with the seated person to the narrowest transverse dimension of the column, such as its width if the cross section of the column is square.

In particular, in open-cell foams such as poly-ether and poly-ester based poly-urethanes, the pressure-displacement characteristic is non-linear. This is in contradistinction to the behavior of an ordinary spring in which the compressive or tensile displacement is proportional to the force applied, in accordance with Hooke's law. The non-linear response of open-cell foams is caused by the cellular nature of the material, and is present to some degree in all visco-elastic open-cell materials, of which foam is the most common. In addition to non-linearity, foams typically deviate from Hooke's law spring response in exhibiting hysteresis: the displacement-pressure curve varies in accordance with whether the foam is undergoing compression or recovery from compression.

Several manufacturers make seats out of more than one foam stiffness with the intention of optimizing the interface pressure with respect to the health, safety, or comfort of the seated person. Examples include U.S. Pat. No. 5,000,515 to Deview and U.S. Pat. No. 5,442,843 to Siekman et al. In addition to the use of foam in manufactured seats, foam seating materials are sold to clinicians for custom construction of seats.

The lifetime of foam cushions is severely shortened if the foam comes in contact with liquids, such as sweat or urine. Seating cushions, therefore, may employ a plastic cover to keep them dry, but the cover is apt to negatively impact the capacity of the cushion to distribute pressure and heat at the interface with the subject. Foam cushions may also be coated with silicone caulking or other waterproofing compound, but such coatings may negatively impact cushion performance.

Cushion shape may be used to improve pressure management performance, and may be customized for the user, however any benefits of specific shaping are compromised if the user is not seated as intended with respect to the cushion.

The deficiencies of foam cushions generally also characterize gel cushions, which, additionally, tend to add significantly to the weight budget of a seating apparatus and the pressure management performance of gel cushions is negatively affected by changes in ambient temperature.

2. Pneumatic Devices for Seating:

Various products use a positive pressure of air or other fluid to manipulate the properties of devices for supporting the human body. These include camping pads, air casts, the ROHO wheelchair cushion (U.S. Pat. No. 4,698,864 to Graebe), and adjustable automobile seats. Products of this sort use fluid bladders to exert pressure on particular portions of the anatomy. The device may consist solely of bladders, a series combination of foam and bladders, or a parallel combination of cushion and pneumatics. In the case of the series combination of foam and bladders, as employed in some auto seats and air casts, the bladders are used to adjust the shape and, therefore, the user's point of contact with the underlying foam cushion. In parallel applications, used in certain wheelchair cushions and camping pads, the foam is typically bonded to the bladders and provides a minimum cushioning in case air pressure is lost, and also significantly modifies the pneumatic impedance of the air bladders should the state of load on them change.

Many of the foregoing devices use a constant mass of air or other fluid, with the volume of the device and the pressure within it varying with the position and actions of the user. For example, if the pad is thick enough that the user does not bottom out, and the user sits on the inflated pad, the user displaces some of the volume of the cushion, and the internal pressure rises, perhaps considerably. As the user's weight shifts around the cushion, the internal pressure generates a balloon effect causing a feeling of instability.

Pneumatic cushions have a narrow range of parameters under which acceptable pressure management performance may be achieved due to sensitivity to ambient temperature and pressure changes over time. Additionally, if a pneumatic cushion develops a hole, it rapidly deflates, leaving the user seated uncushioned on the cushion substrate.

SUMMARY OF THE INVENTION

In accordance with an embodiment of the present invention, there is provided a cushion system for supporting a mass. The cushion system has an array of foam members disposed such that the compression and relaxation of each foam member is substantially independent of all other foam members. Additionally, the cushion system has a matrix for retaining the array of foam members in a supporting configuration with respect to the mass. In accordance with an alternate embodiment of the present invention, the matrix may be an array of attachments between the foam members and a continuous bottom sheet. The outside surface of each foam member may be separated over the entire length of each foam member by a lubricating material such that any shear force transmitted between each foam member and any other foam member is insubstantial. In accordance with an alternate embodiment of the invention, the outside surface of each foam member may be at least partially enclosed. The supported mass may be a person, seated or recumbent. Additionally, the supported mass may be an item of cargo. Each foam member may have the aspect ratio of a short column and each foam member may have the aspect ratio in the range between approximately one-to-two to approximately three-to-one. Each foam member may exhibit substantially constant force per unit area when supporting the mass and may have a transition pressure, as defined below, exceeding 80 mm Hg, or substantially in the range of 25 to 80 mm Hg. In this description and in the claims appended hereto, pressure and stress are expressed in units of millimeters of mercury (mm Hg), or in pounds per square inch gauge (psig), where 1 mm Hg corresponds to 0.0193 psig.

In accordance with further alternate embodiments of the invention, each of the foam members may have a width such that structural features of the supported mass do not exert shear forces on each other by virtue of being supported by the cushion, and each of the foam members may have a width less than 4 inches. The foam members may be encapsulated in an integral skin which may be impermeable to liquid, may be urethane, and may be formed from plastic sheet.

In accordance with another aspect of the present invention, in one of its embodiments, there is provided an adjustable cushion system having a cushion made of open-cell foam, a pressure system for providing a fluid to the open-cell foam, and a controller for regulating the pressure of the fluid. In alternate embodiments of the invention, the fluid may be a gas, and the cushion may have an interior, The adjustable cushion system, in another of its embodiments may include a flexible, airtight covering having an interior, with the pressure system providing the fluid to the interior of the covering.

In accordance with yet further alternate embodiments of the present invention, the pressure system may provide a fluid at a pressure either less than or greater than ambient pressure. The cushion may include a plurality of open foam members, and the pressure system may provide the fluid to the plurality of open foam members, either individually or in groups. Each member may have a flexible covering, and the flexible covering may be airtight.

By virtue of the innovations taught with respect to the present invention, a cushion is provided which may combine the pressure distribution characteristics of a pneumatic seat cushion with improved stability, a benign failure mode, and the advantages of effectively floating an object on a solid cushion.

DETAILED DESCRIPTION OF SPECIFIED EMBODIMENTS

Figure 1:
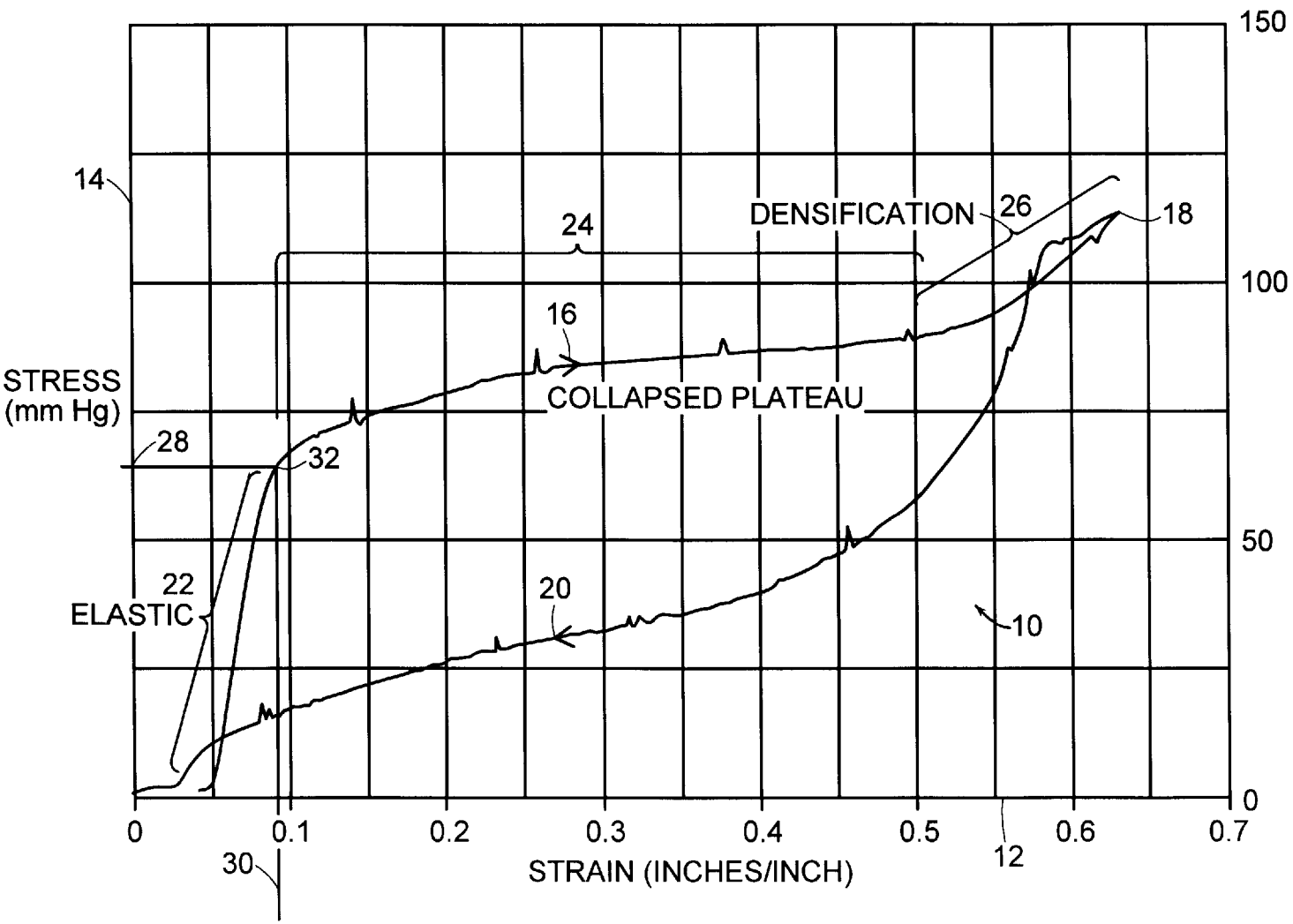
FIG. 1 is a typical experimental hysteresis loop showing stress plotted as a function of strain for an open-cell foam.

Preferred embodiments of this invention use the property of nonlinearity of the displacement-pressure (or stress-strain) hysteresis curve characterizing foam materials. The displacement-pressure hysteresis curve of a typical foam is discussed with reference to FIG. 1, where the displacement-pressure hysteresis curve is designated generally by numeral 10. Horizontal axis 12 is graduated in strain, or the fractional displacement of a test weight compressing the foam as a fraction of the thickness of the foam, in units of inches per inch, with the origin corresponding to no displacement. Displacement increases toward the right. Vertical axis 14 is graduated in millimeters of mercury. The test protocol described by displacement-pressure hysteresis curve 10 proceeds along a branch of increasing force and displacement (indicated by right-pointing arrows 16), until limit 18 of the test, at which point the force is decreased and the foam relaxes according the branch of hysteresis curve 10 indicated by left-pointing arrows 20. Hysteresis refers to the distinct shapes of the two branches of curve 10 in the respective directions of increasing and decreasing pressure.

Both experimental evidence and theory show that an initial portion 22 of displacement-pressure hysteresis curve 10 is approximately linear-elastic, i.e., the stress-strain relationship is in accordance with Hooke's Law. Thus, during linear elastic phase 22, the force supported by the foam for a given displacement increases proportionately with the displacement. During further portions of displacement-pressure hysteresis curve 10, the foam passes through a "collapse plateau" 24 and finally a "densification" phase 26. Collapse plateau 24 is also referred to as a "collapse" phase. The term "transition pressure" as used in this description and in the appended claims, will refer to the pressure 28 at which the transition occurs, upon compression, between the linear-elastic and the collapse phases of the foam. Alternatively, the transition pressure may be referred to as the "collapsing threshold." Similarly, the transition displacement 30 refers to the displacement of the material at first inflection point 32 of the pressure-displacement hysteresis curve. There is broad agreement in the literature that the transition to collapsed-plateau phase 24 is due to buckling of the cellular walls of the material.

A further aspect of foam behavior is that the volume of the foam cell does not change significantly in elastic phase 22 with minor increments of load. If the load exceeds the collapsing threshold 28, the foam rapidly collapses until the load is relieved or until the foam reaches the densification phase 26. In general, densification phase 26 is reached at approximately 25% of the initial volume of the foam. In accordance with an embodiment of the invention, the relatively flat nature of collapsed plateau phase 24 is used to advantage to provide substantially constant pressure against the body of a person seated on a cushion. A person seated on a cushion thus designed in accordance with an embodiment of the present invention can be said to be effectively "floating on a solid" in that the force per unit area experienced by the body of the person is substantially independent of the orientation and position of the body on the cushion. Moreover, the displacement of fluid attendant to floatation of a body on a fluid is substantially eliminated.

Figure 2:
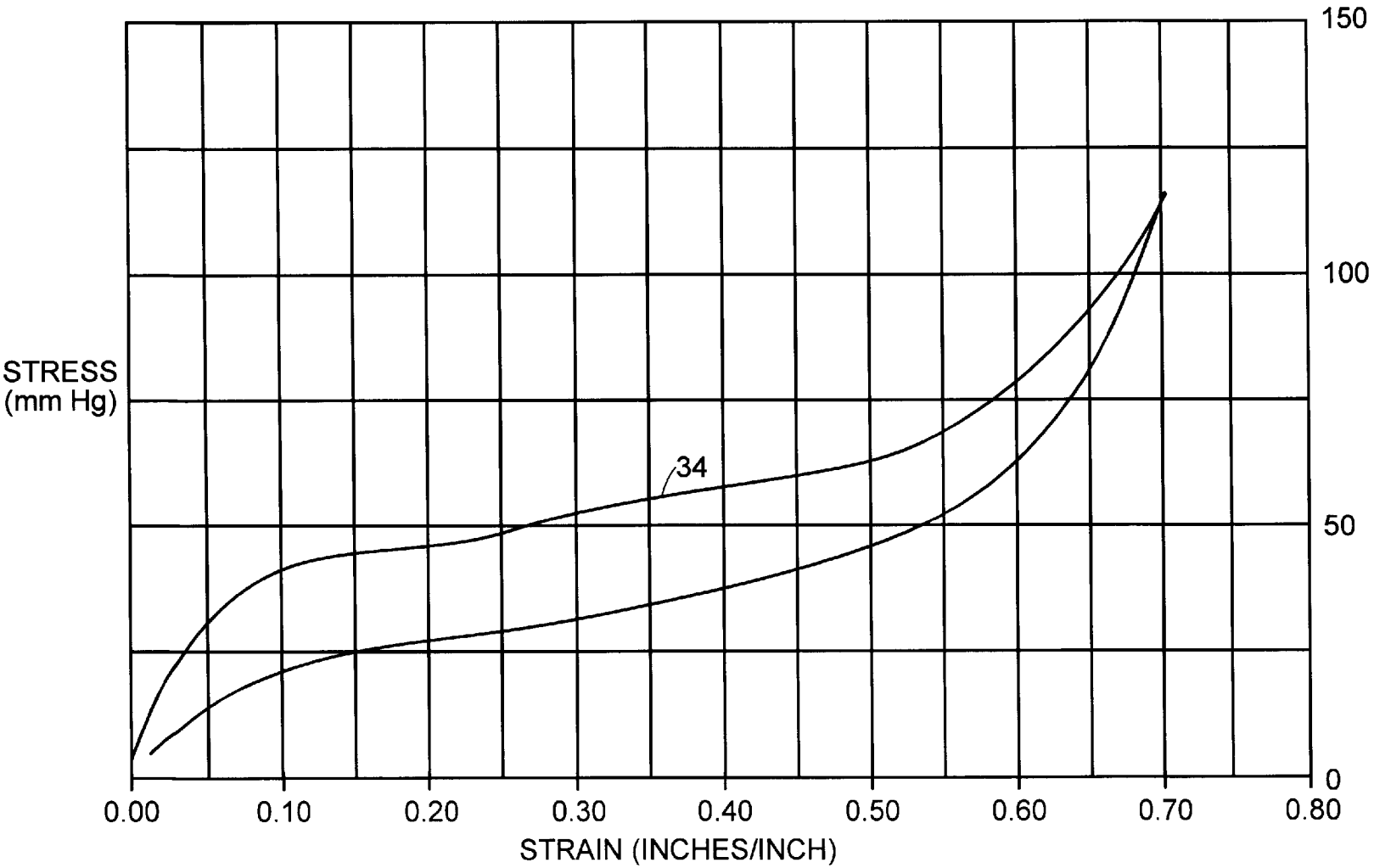
FIG. 2 shows the displacement-pressure hysteresis loop of a foam material suitable for a cushion for seating applications in accordance with an embodiment of the present invention.

Materials having the characteristics of a flat collapsed plateau 24 occurring after a sharp first inflection point 32 (also referred to as a "knee" of curve 10) at a transition pressure in a typical range of 25–80 mm Hg are preferred, in accordance with one embodiment of the invention for seating applications. When the supported mass is a piece of cargo or otherwise non-human, higher pressures may be desirable. Specific foam type determines the stiffness range in which the device operates, but a wide variety of foams may be applied within the scope of the claimed invention. The flatness of curve 10 implies that a substantially constant maximum force is being applied to support the seated person. Referring to FIG. 2, displacement-pressure hysteresis curve 34 corresponds to a foam material having desirable characteristics, namely polyether foam Grade 2560CFR, manufactured by OD Flexible Foam of the Ohio DEC Plastic Group. This foam may be obtained from Special Design Products, Columbus, Ohio.

Figure 3:
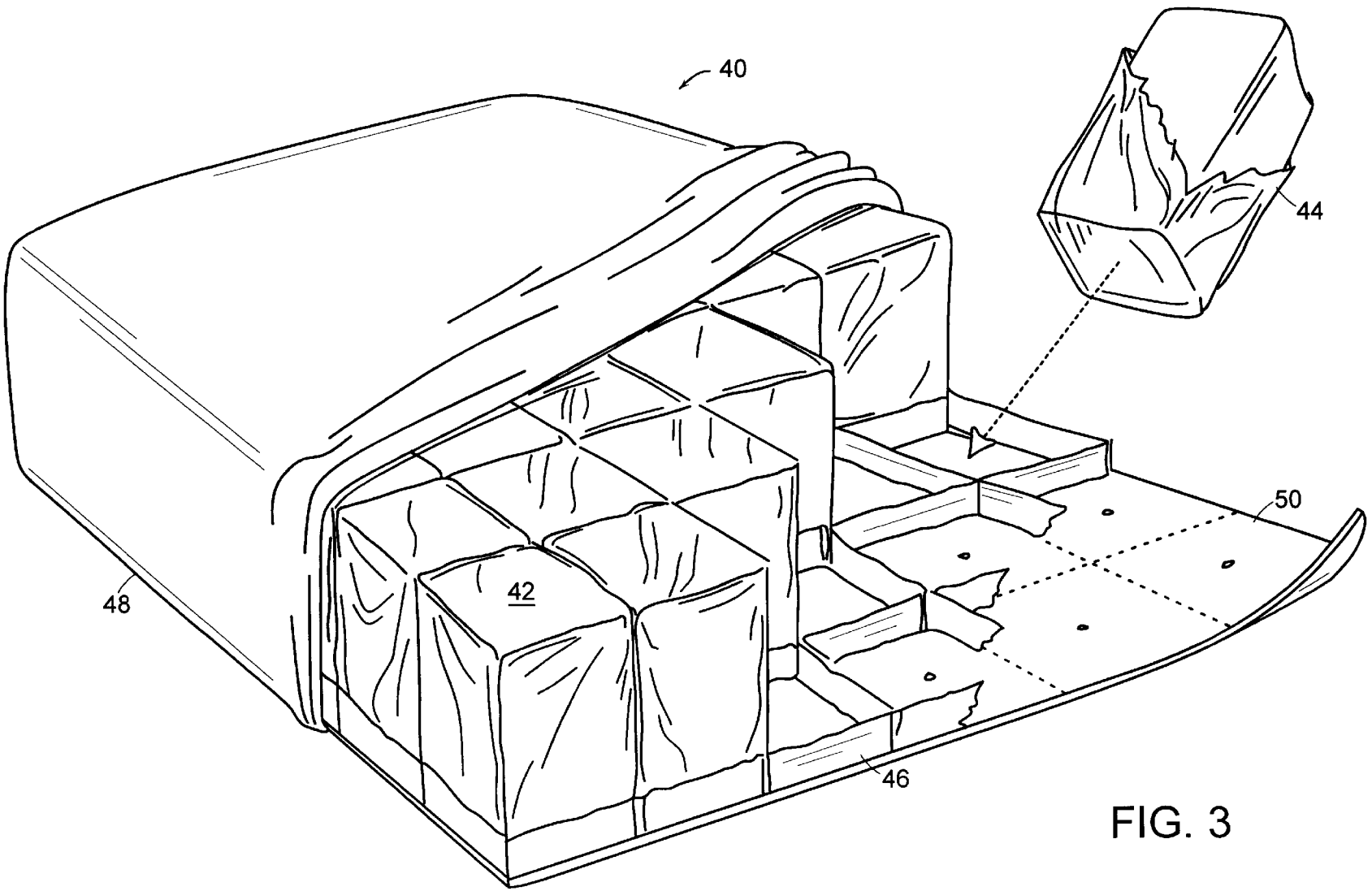
FIG. 3 is a cut-away perspective view of a seating cushion in accordance with an embodiment of the present invention.

Referring now to FIG. 3, a cut-away perspective view is shown of a seating cushion, designated generally by numeral 40, in accordance with an embodiment of the present invention. Cushion 40 contains one or more foam cells 42, also referred to as foam members, arranged side-by-side in an array which may, for example, form a rectangle of m×n cells, but need not have a regular shape. Similarly, foam cells 42 are shown as right columns, but foam cells 42 may assume other shapes within the scope of the claimed invention. In one embodiment, foam cells 42 are arranged in a 6×6 matrix, where each cell has a square cross-section, approximately 2.5 inches on a side, and each cell is approximately 3.5 inches tall. Each cell consists of a block of open-cell foam enclosed in a skin (or "bag") 44 of flexible, airtight film which may be made of urethane, for example. Bag 44 enclosing each foam cell may serve a number of functions. Bag 44 may protect the foam from spills or other wetness which might otherwise promote the growth of mold and shorten the useful lifetime of the cushion. Another function is to provide lubrication during the relative motion of adjacent foam cells. Thus, in a seating application, areas prone to higher incidence of pressure sores, such as the ischials, sacrum, trochanters, etc., are supported by separate and independently compressible members, so that both peak pressures and shear forces are reduced.

Cushion 40 is contained in a fabric matrix (or "web") 46 which constrains the individual cells to remain in a particular geometric relationship. Matrix 46 is any structure or attachment means which permits free vertical movement of foam cells 42, but minimizes lateral motion. Alternatively, foam cells 42 (otherwise referred to as "columnar members") or bags 44 may be bonded at their bottom surfaces to a continuous bottom sheet 50, discussed further below. Bonding of the bottom surfaces of cells 42 to continuous bottom sheet 50 may be, for example, by welding or adhesive. Matrix 46 may have an upper surface 48 constructed of a material, such as a spandex fabric, for example, that permits free movement without skin effects. Additionally, upper surface 48 may also advantageously be waterproof.

In one embodiment of the present invention, the waterproof cover (or, waterproofing membrane) 48 may be divided into multiple parts corresponding to subparts of the cushion. Such a cover provides the benefits of waterproofing without introducing skin effects that degrade the pressure distribution performance of the cushion. Since individual sections of cover 48 are of smaller surface area than a monolithic cover would be, thinner material may be used while retaining equivalent wear and puncture resistance.

The cushion rests on a bottom surface 50 which may have a flexibility substantially less than that of the other components of cushion 40. In particular, attachment of bags 44 to bottom surface 50 by welding, sewing, or bonding of any sort, holds bags 44 in substantially fixed relative horizontal relation. Examples of materials suitable for bottom surface 50 include sheet plastic or low-stretch fabric. The structure described in terms of an integral matrix 46 and upper surface (or "cover") 48 may be found to be advantageous in terms of ease of construction and cost of manufacture.

An advantage of the multicellular structure of cushion 40 is that it allows tailoring to the support of an object of arbitrary shape or to the prevention of excess pressure on a sore or an anatomical protrusion. For example, an object of some arbitrary irregular shape is on a cushion constructed according to the present invention. Should the pressure at any area of the object exceed the pressure at the elastic/collapsing transition of the foam, the foam in that area would plastically move away from the object. This slight movement would cause other areas of the object to bear an increased portion of the weight, and the pressure in the area under consideration to bear less accordingly. Additionally, the height of individual members of the foam array may be customized to accommodate a particular feature of the supported object.

Figure 4:
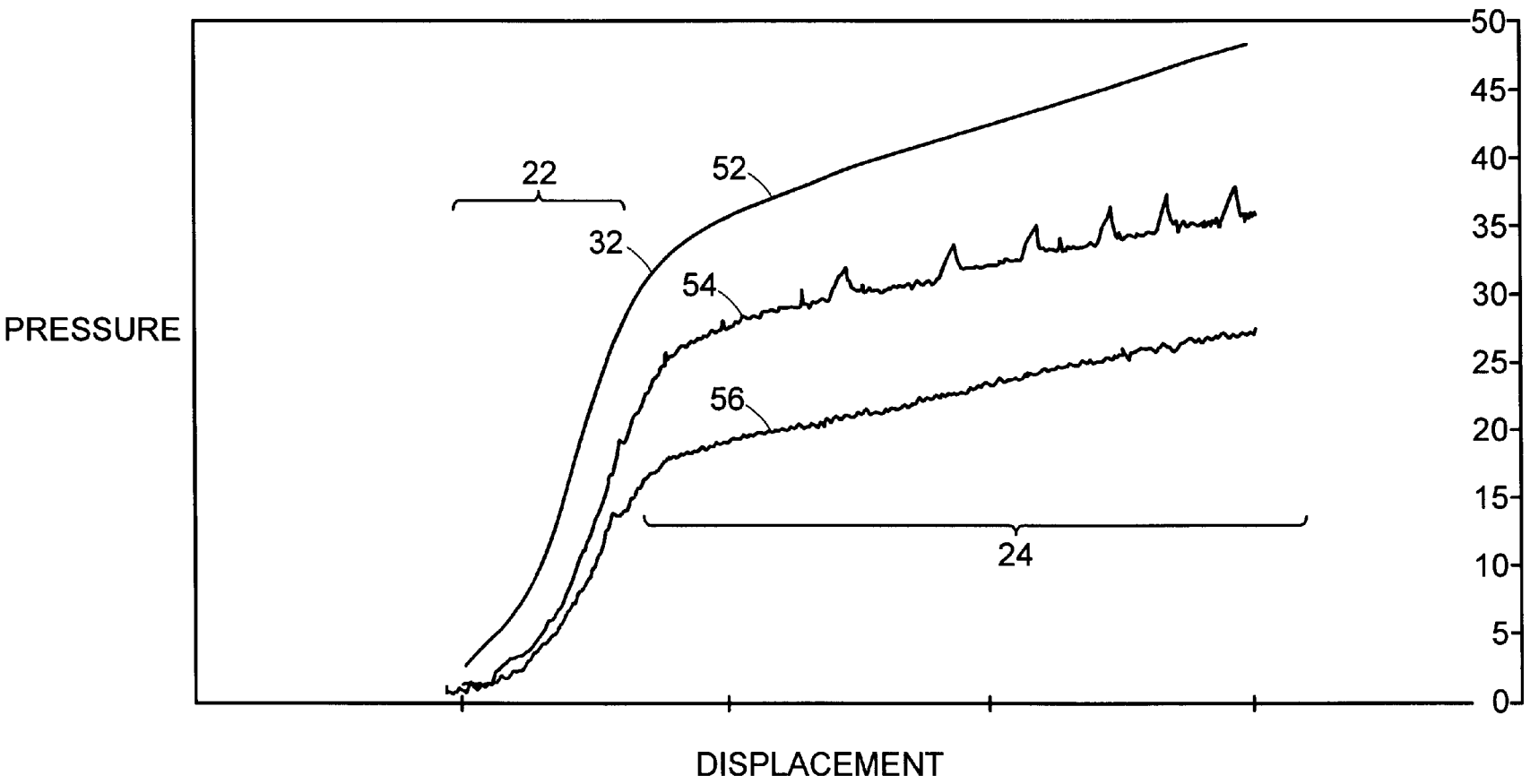
FIG. 4 shows the effect on displacement-pressure curves of applying vacuum on the placement of the collapsing transition point for a particular open-cell foam.

Referring now to FIG. 4, we have discovered that by applying vacuum or positive pressure, on the order of less than 1 psig, to a pneumatically isolated mass of open-cell visco-elastic material (e.g. a block of foam within a flexible airtight skin), it is possible to control the mechanical loading necessary for the material to move from linear elastic phase 22 into collapsed phase 24. Three displacement-pressure curves 52, 54, and 56 are shown in FIG. 4. Curve 52 corresponds to a foam open to the ambient atmosphere, while curve 54 corresponds to the same foam to which a light vacuum of approximately −0.1 psig has been applied, and curve 56 corresponds to the same foam with a vacuum of approximately −0.25 psig applied. The total force applied to the material (pneumatic force+mechanical force) at the transition point 32 remains approximately constant, but because we are able to control the applied pneumatic pressure, we are effectively able to control the mechanical force required to induce buckling. In fact, the total force (pneumatic+mechanical) at which collapsing behavior begins remains approximately constant, even though the individual mechanical and pneumatic components can be made to vary.

Pneumatic pressure and mechanical load may be combined to put the foam into its collapsed phase, whereupon the foam collapses until the load is relieved or it reaches the material's densification phase. By biasing the displacement-pressure curve in this manner, both tailoring and active control may be achieved with respect to the pressure exerted on individual elements of the supported object by foam members of the cushion. Since application of a vacuum or positive pressure to a particular cell of the cushion allows the transition point to be varied, in the optimum case, the elastic/collapsing transition point of the foam could be set just infinitesimally above the average pressure (weight per unit area) exerted by the object. After a period of settling (and neglecting any shear effects, skin effects, etc.), the pressure at any particular point on the object could be constrained to be equal to the average. Should the area of the object in contact with the foam increase (say, as a result of taper) during the transition, this should further tend to decrease the pressure on the object at any given point.

The discovery can be utilized in any application in which it is desirable to constrain the maximum force at any particular point applied to an object. An example of this is the provision of an improved adjustable seat cushion, particularly one for use in a wheelchair. In this application, the invention may offer the following advantages over existing wheelchair cushions. The application of pressure or vacuum to set the transition pressure of individual cells to near the transition to the collapsed plateau region of substantially constant pressure allows for more optimal control of the pressure on a seated person, thereby reducing peak interface pressures and helping in the prevention of pressure sores. Additionally, if higher levels of vacuum (on the order of 2 to 5 psig) are applied to a small sector of the cushion, it can be compressed to a volume considerably smaller than it's normal state. This has the effect of pulling that area of the cushion out from underneath the user, temporarily and substantially lowering the local interface pressure. By periodically applying this technique to various areas of the cushion, pressure can be varied in a way equivalent to a squirming motion. A significant advantage of this method is that it permits periodic pressure relief without significancy changing the position of the user. Traditional methods of pressure relief involve lifting the user −3 inches, or rotating about 45 degrees--a significantly intrusive procedure.

One foam that is suitable for use in the actively pressurized cell application is the material whose stress-strain hysteresis curve 10 is depicted in FIG. 1. The material is polyether foam Grade 15080, manufactured by OD Flexible Foam of the Ohio DEC Plastic Group. This foam may be obtained from Special Design Products, Columbus, Ohio.

Figure 5:
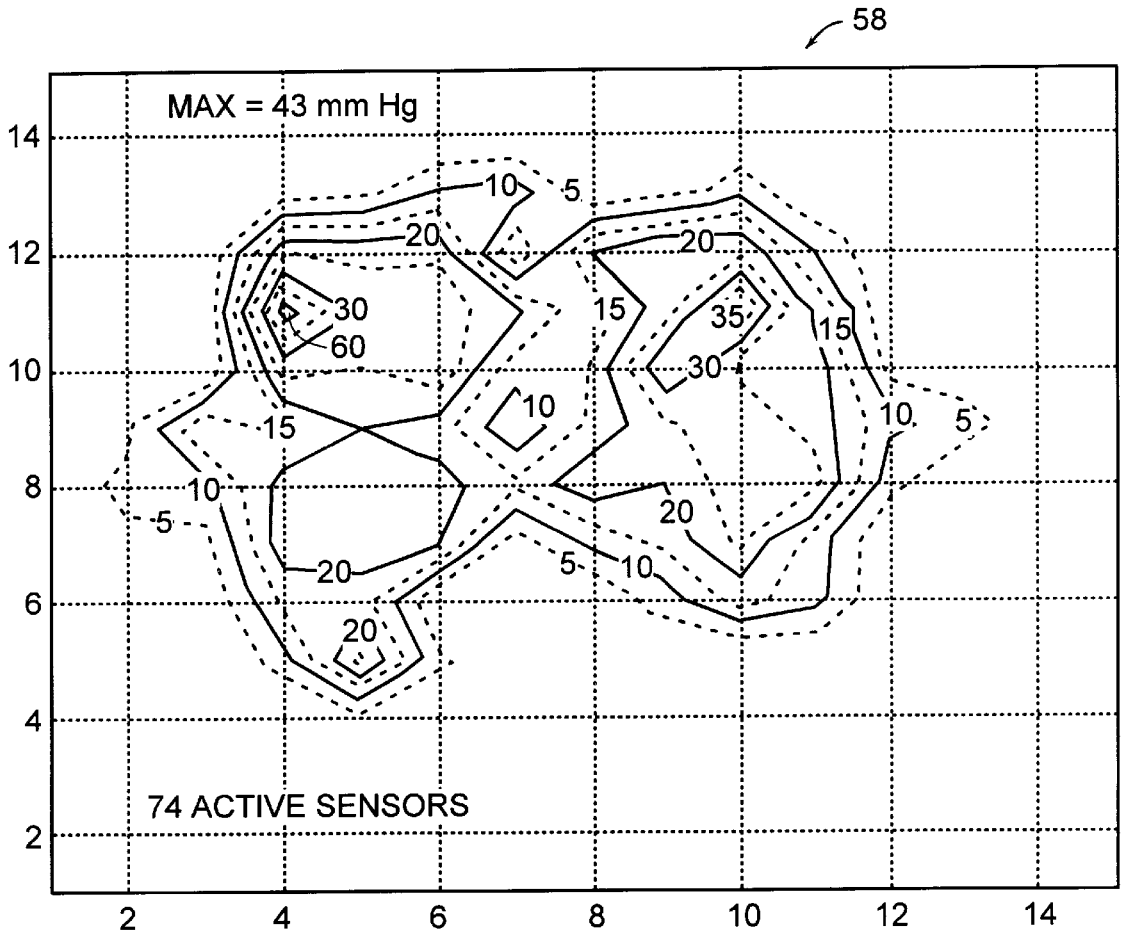
FIG. 5 shows a contour map of the pressure exerted by a simple uncontrolled cushion on an artificial buttock.
Figure 6:
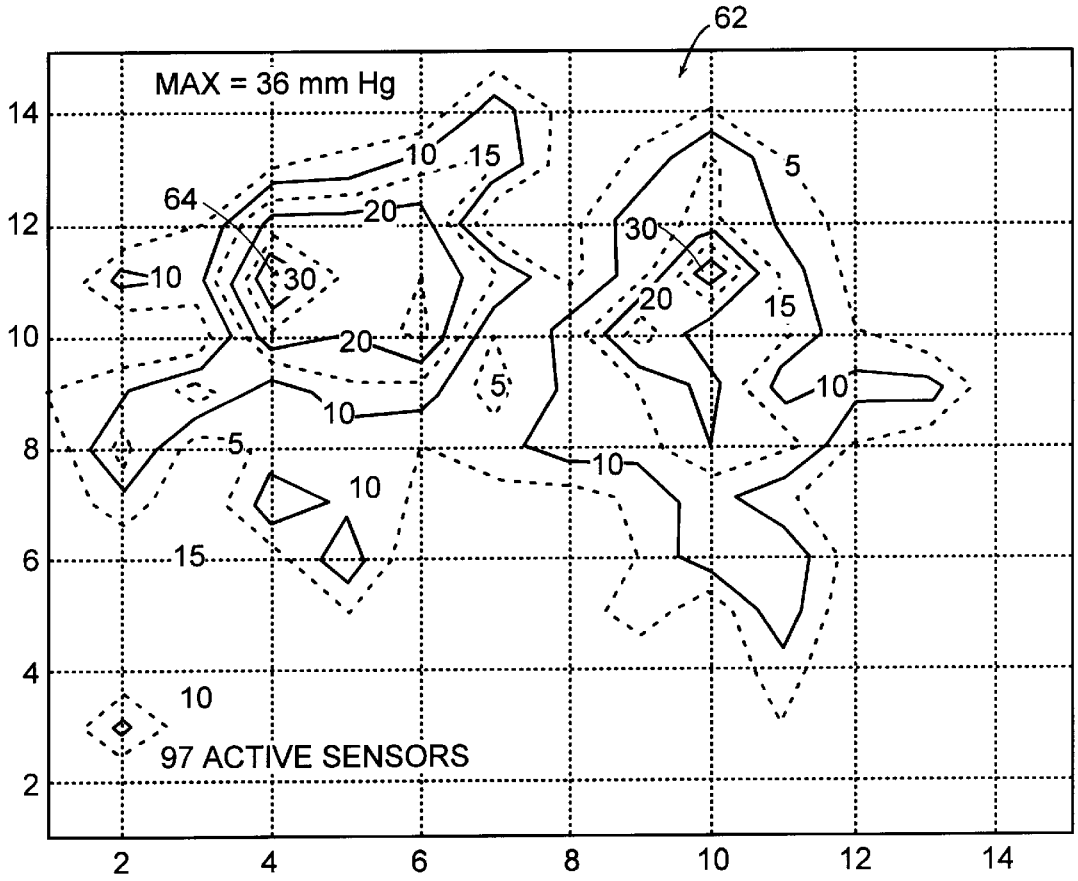
FIG. 6 shows a contour map of the pressure exerted on the artificial buttock of FIG. 5 by a cushion with vacuum applied in accordance with an embodiment of the present invention.

The effectiveness of the invention may be appreciated by reference to FIG. 5 wherein a contour map 58 is shown of the profile of pressure exerted by a typical uncontrolled cushion on a test fixture simulating a human buttock. FIG. 5 depicts the baseline case; the maximum pressure at any point is point 60 where a pressure of 43 mm Hg is exerted. By way of contrast, FIG. 6 shows a contour map 62 of the profile of pressure exerted on the same artificial buttock as referred to with respect to FIG. 5, however, in the case of FIG. 6, vacuum has been applied to the cushion, thereby more favorably biasing the internal pressure. The maximum pressure, which occurs at point 64, has fallen to −35 mm Hg. Additionally, the entire distribution of pressures has shifted toward lower pressures. Note that the area of low pressure areas around the perimeter has expanded somewhat; the load is spreading to a larger area. As expected, the areas under the simulated ischials show the greatest pressure relief. Note that the pressure along the center line has fallen significantly as well. This effect persists over time; tests of over two hours have been conducted, with consistent results.

Figure 7:
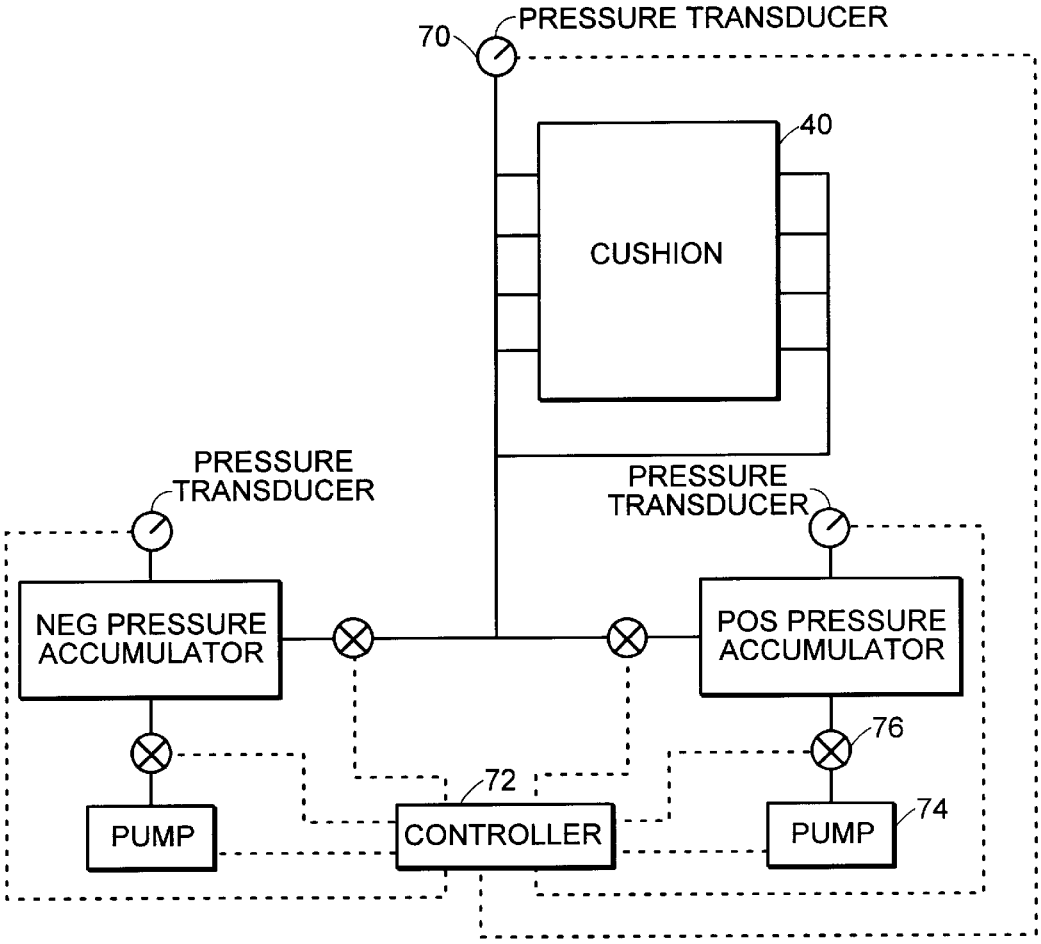
FIG. 7 is a schematic of the monolithic cushion with active control of pressure according to one embodiment of the present invention.

Referring now to FIG. 7, in a preferred embodiment of the present invention, a single monolithic cushion is used and is enclosed in a flexible, airtight film. FIG. 7 depicts a schematic of one such embodiment. Vacuum or positive pressure is applied to the entire cushion 40 to bias the net force acting on portions of the cushion to near the transition pressure. Pressure is monitored by a pressure transducer 70 which produces a signal indicative of the pressure in cushion 40, and the signal is fed to a controller 72 to regulate pumps 74 and valves 76 in order to maintain a desired pressure.

Figure 8:
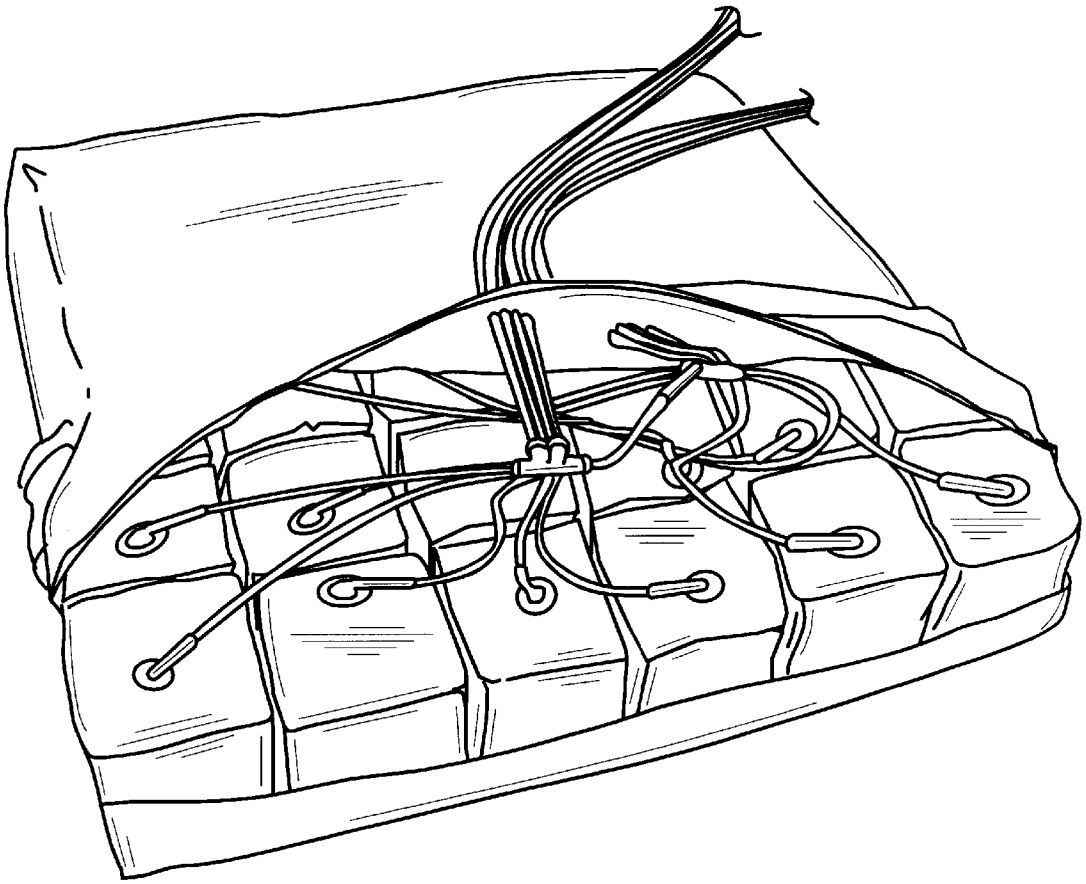
FIG. 8 is a photograph showing the internal modular structure of an adjustable-cushion system in accordance with an embodiment of the present invention.
Figure 9:
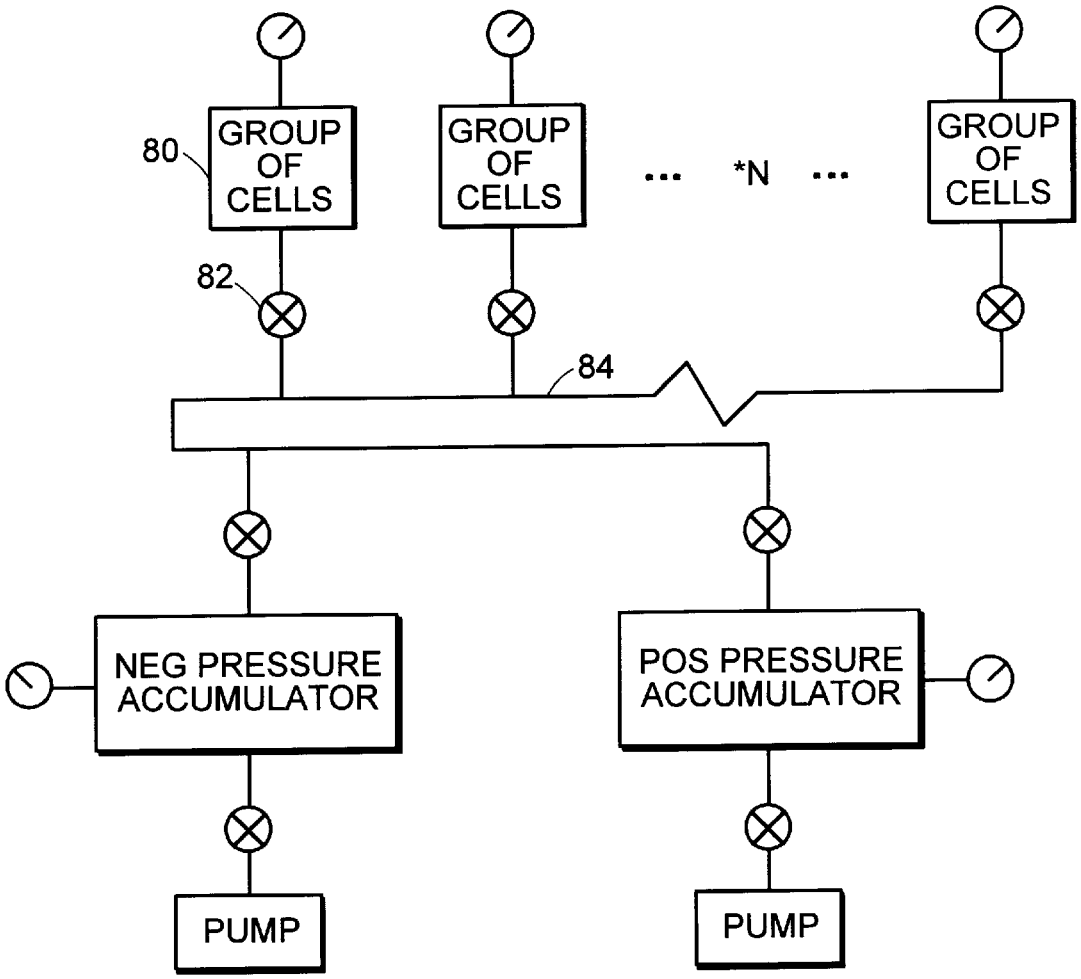
FIG. 9 depicts a schematic diagram of a valving scheme for a modular-type cushion system according to an embodiment of the present invention.
Figure 10:
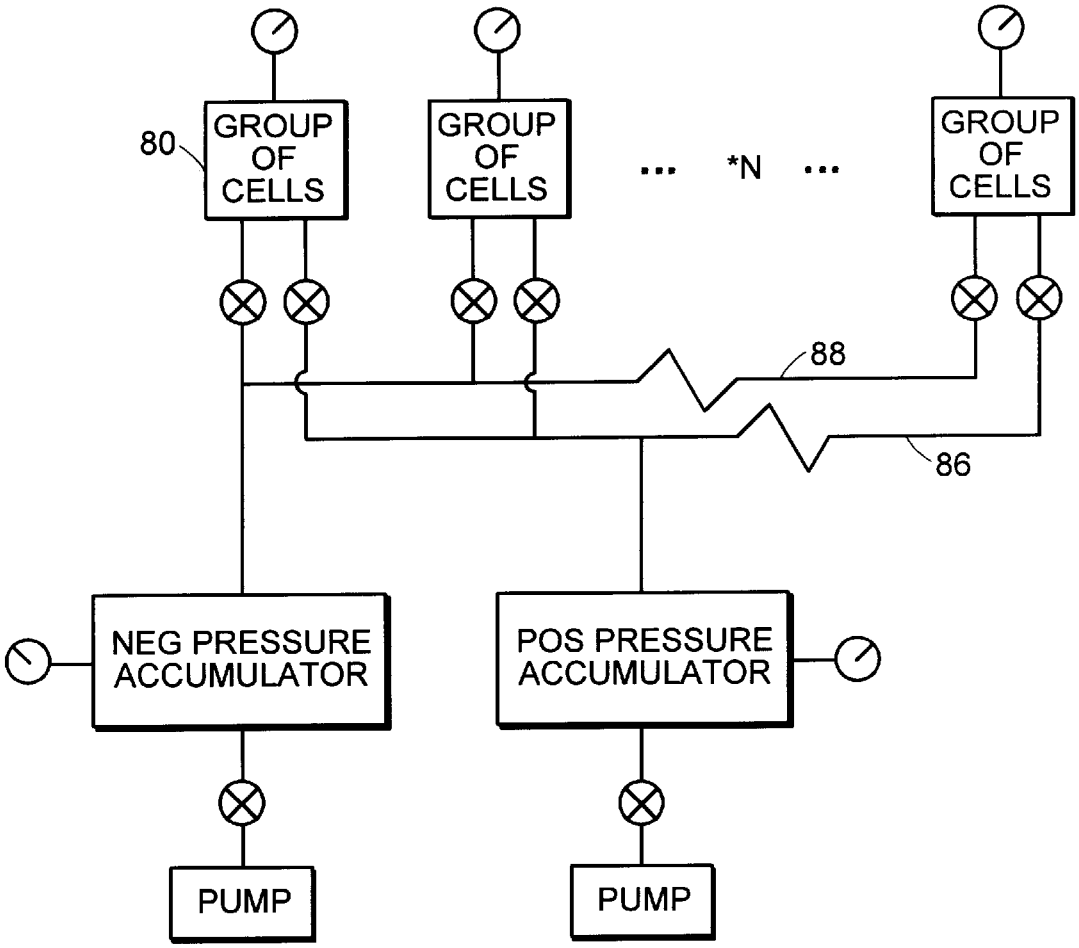
FIG. 10 depicts a schematic diagram of an alternative valving scheme for a modular-type cushion system according to a further embodiment of the present invention.

The configuration described above in reference to FIG. 3 in which multiple foam cells are disposed in an array, is shown, in perspective view, in FIG. 8. An alternative configuration is depicted schematically in FIG. 9, wherein each cell is connected by means of flexible tubing to one or more additional cells to form a group 80. Each group 80 is connected to a valve 82 which pneumatically isolates it from a manifold 84. Each group 80 is at a common pneumatic pressure. Individual cells contained within a group 80 need not be physically contiguous, thus various pressure control strategies may be implemented. One strategy provides that the sum of moments due to pressure on the cells of interest about the center of pressure is zero so that active manipulation of the cell array does not have the effect of shifting the center of gravity of a person seated on the cushion. Manifold 84 may be controlled to any arbitrary pressure. By opening valve 82 connecting a group 80 of cells to manifold 84, group 80 may be brought to any arbitrary pneumatic pressure. This configuration of individually addressable groups of cells is referred to as modular cushion control. An alternative scheme for controlling pressures in groups 80 of cells is depicted in FIG. 10. In this embodiment of the present invention, separate manifolds 86 and 88 are provided for vacuum and positive pressure, respectively.

Figure 11:
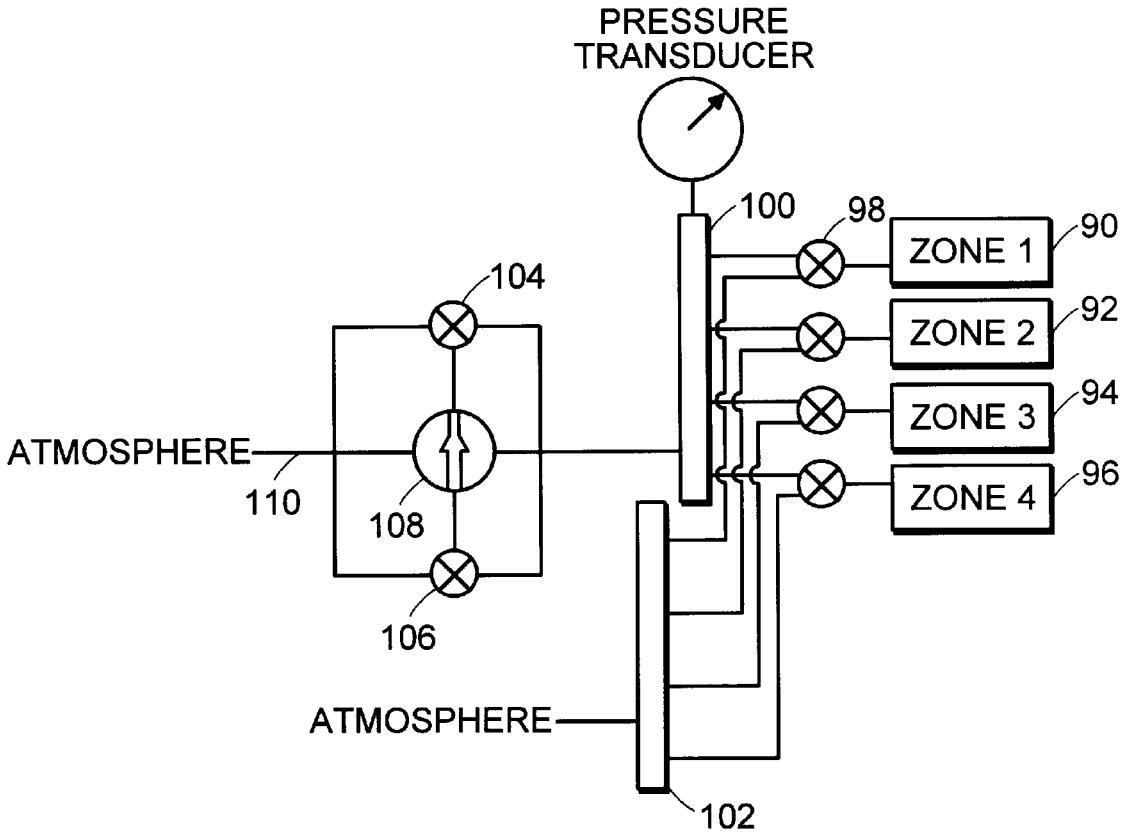
FIG. 11 depicts a schematic diagram of a further alternative valving scheme for a modular-type cushion system according to another embodiment of the present invention.

Referring now to FIG. 11, a further alternative scheme for controlling pressures in groups of cells 80 is shown. Multiple zones 90, 92, 94, and 96 of cells are individually addressed by control valves 98 which may be activated alternatively to connect a particular zone either to pressure manifold 100 or to allow that zone to vent to the atmosphere via a manifold 102. Valves 104 and 106 control access to pressure manifold 100 from vacuum pump 108 and atmospheric port 110. On a periodic basis, typically on the order of four times per hour, a particular zone, for example zone 90, is addressed and pressure relief is performed in the following manner. Zone 90 is connected by valve 98 to pressure manifold 100, while the remaining zones are vented to the atmosphere via manifold 102. Vacuum pump 108 operates and valves 104 and 106 are configured so that a partial vacuum is pulled on the cells of zone 90 until the appropriate set point is reached, typically on the order of −2 psig. Valves 104 and 106 are toggled to isolate zone 90 and pump 108 is deactivated. For the next period of time, typically 2–3 minutes, pump 108 is activated, as needed, to "top off" zone 90 in order to compensate for small leaks or hysteresis effects in the foam. After this 2–3 minute interval, valve 98 is toggled to allow zone 90 to return to atmospheric pressure. Valves 104 and 106 may then be configured to achieve a slight overpressure of zone 90, on the order of 0.1 psig, for a period on the order of 30 seconds. Zone 90 is then vented, again, to the atmosphere, and the process is repeated for another zone. Variations of the described pressure relief stratagem may also be achieved using the configuration shown.

Figure 12:
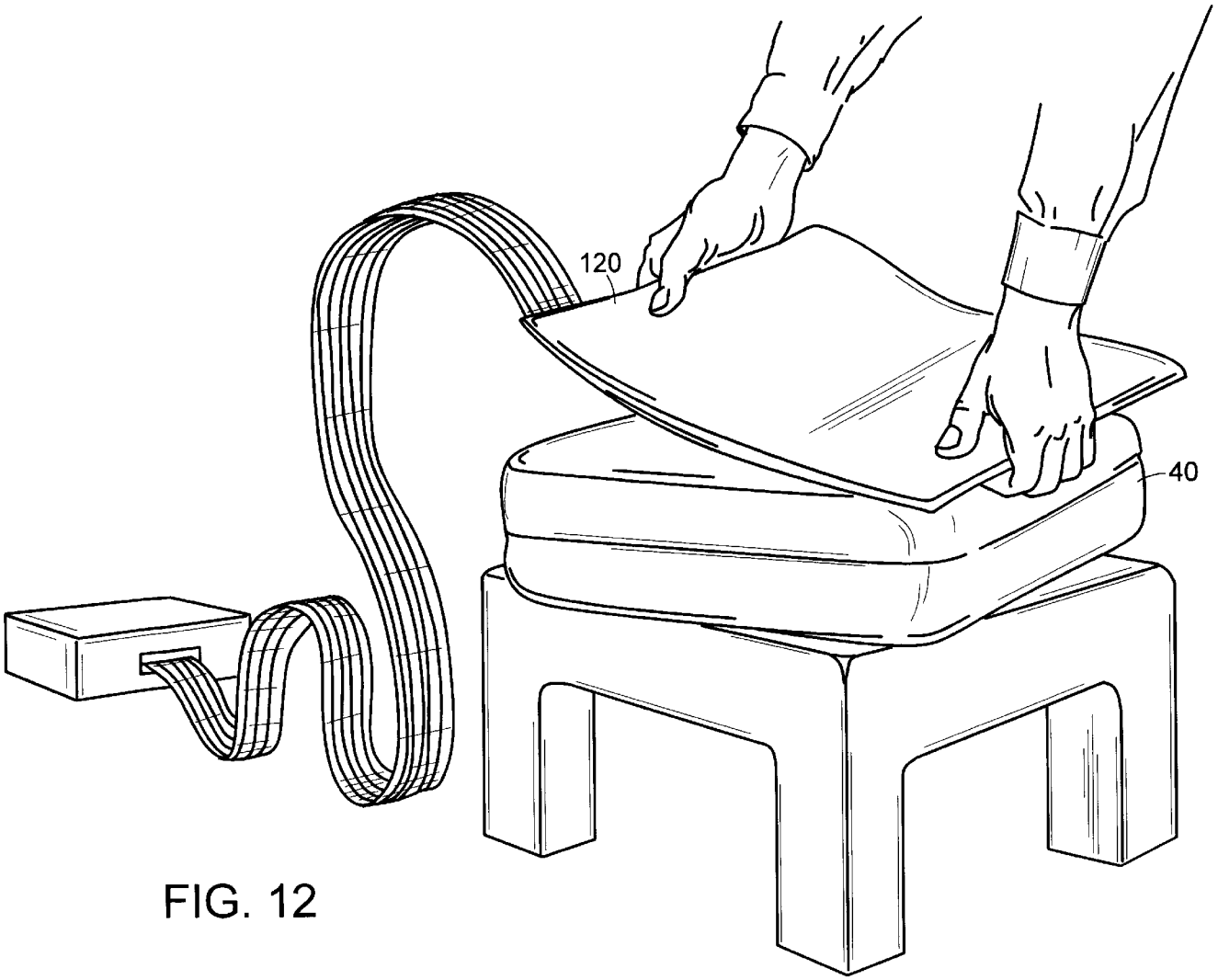
FIG. 12 is a photograph of an adjustable-cushion system of the present invention, with a pressure-transducer pad placed on top thereof.

Referring to FIG. 12, pressure transducer output is derived from a set of pressure sensors disposed within pressure transducer pad 120 positioned between cushion 40 and the supported object or person. Such a pad 120 can be used to evaluate the effectiveness of a particular seat cushion.

As in the case of the passive seat cushion described above, the active cushion, to which vacuum or pressure is applied, is contained in a fabric cover which constrains the individual cells to remain in a particular geometric relationship. The fabric permits free vertical movement, but limits lateral motion. The upper surface of the cover is constructed of material (e.g., spandex) that permits free movement without skin effects that would couple the foam cells by lateral forces.

The cushion rests on a solid base, which contains holes as appropriate to permit connection of the tubing between foam cells, and between groups of cells and the valve manifold. In accordance with one embodiment of the present invention, the cushion may be operated in a passive mode, with the foam cells open to the ambient environment via multiple bulkhead connectors at the base of the cushion. Alternatively, plumbing may be incorporated into the bottom sheet of the cushion. An option is provided of connecting hoses to the bulkhead connectors in order to apply vacuum or pressure in accordance with other teachings of the present invention.

Figure 13:
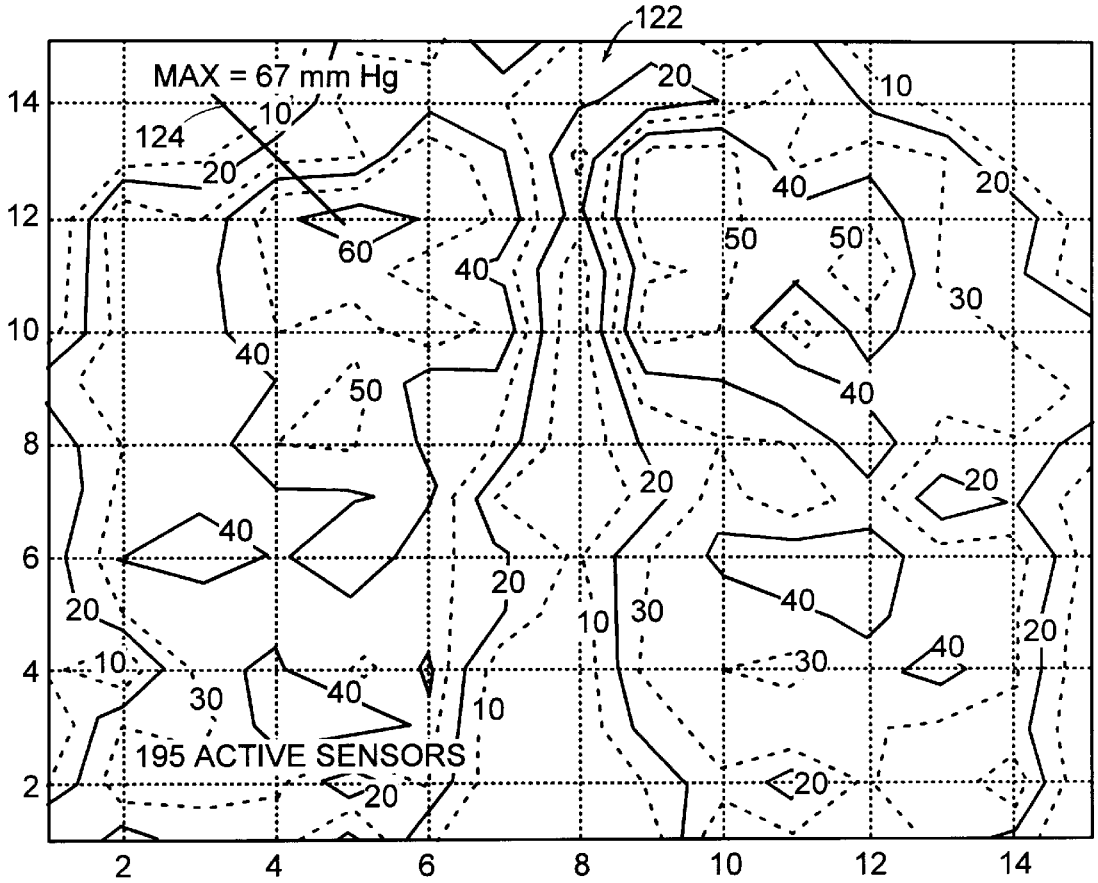
FIG.13 shows a contour map of the pressure incident on a person seated on a modular-type cushion in accordance with an embodiment of the present invention.

FIG. 13 shows a contour map 122 of the profile of pressure exerted on a seated person, with the cell pressure regulated in a modular fashion in accordance with an embodiment of the present invention. The maximum pressure of 67 mm Hg is indicated at position 124. In addition to being applicable to applications where pressure sores are a concern (e.g., wheelchairs or beds), the present invention may also be applied to any situation where long-term immobility and pressure management or relief are issues (e.g., automotive seating, military aircraft, nursing homes), and/or in any situation where movement or squirming is undesirable and/or impossible. The present invention is also applicable to certain packing situations, in which cases, the body supported by the cushion is an item of cargo. The described embodiments of the invention are intended to be merely exemplary and numerous variations and modifications will be apparent to those skilled in the art. All such variations and modifications are intended to be within the scope of the present invention as defined in the appended claims.

We claim:

1. A cushion system for supporting a body of a person, the cushion system comprising:

a. a plurality of foam members, each foam member having an outside surface and a length, each foam member exhibiting substantially constant pressure over a range of compression of the member caused by providing support to the body, the range of compression corresponding to constant pressure having an onset substantially at a pressure exerted by the supported body of the person, each foam member disposed such that the outside surface of each foam member is substantially separated from the outside surface of any other foam member under conditions of both compression and relaxation of any foam member; and b. a matrix for retaining the foam members in a supporting configuration with respect to the body.

2. A cushion system according to claim 1, wherein the matrix is an array of bonds between the foam members and a continuous bottom sheet.

3. A cushion system according to claim 1, wherein the outside surface of each foam member is separated over the entire length of each foam member by a lubricating material such that any shear force transmitted between each foam member and any other foam member is insubstantial.

4. A cushion system according to claim 1, wherein the outside surface of each foam member is at least partially enclosed.

5. A cushion system according to claim 1, wherein each foam member has an aspect ratio of a short column.

6. A cushion system according to claim 1, wherein each foam member has an aspect ratio within the range between approximately one-to-two and approximately three-to-one.

7. A cushion system according to claim 1, wherein each foam member has a width less than 4 inches.

8. A cushion system according to claim 1, wherein the body is a person.

9. A cushion system according to claim 1, wherein the body is a seated person.

10. A cushion system according to claim 1, wherein the body is a recumbent person.

11. A cushion system according to claim 1, wherein the body is an item of cargo.

12. A cushion system according to claim 1, wherein each foam member is encapsulated in a flexible skin.

13. A cushion system according to claim 12, wherein the flexible skin is substantially impermeable to fluids.

14. A cushion system according to claim 12, wherein the flexible skin is urethane.

15. A cushion system according to claim 12, wherein the flexible skin is formed from plastic sheet.

16. A cushion system according to claim 1, further including a waterproofing cover disposed between the foam members and the supported body.

17. A cushion system according to claim 16, wherein the waterproofing cover is segmented.

18. A cushion system for supporting a body of a person, the cushion system comprising:

a. a plurality of foam members, each foam member exhibiting substantially constant pressure over a range of compression of the member caused by providing support to the body, the range of compression corresponding to constant pressure having an onset substantially at a pressure exerted by the supported body of the person, each foam member disposed such that the outside surface of each foam member exhibits separation from the outside surface of any other foam member under conditions of both compression and relaxation of any foam member, wherein the separation includes a lubricating material such that any shear force transmitted between each foam member and any other foam member is insubstantial; and b. a matrix for retaining the array of the plurality of foam members in a supporting configuration with respect to the body.

19. An adjustable cushion system for supporting a body of a person, the adjustable cushion system comprising:

a. a cushion comprising a plurality of cells, each cell having open-cell foam, said foam exhibiting a transition between a linear dependence of pressure on displacement and a collapsed plateau the transition dependent upon applied pressure;

b. a pressure system for providing a fluid to the open-cell foam; and c. a controller for regulating the pressure of the fluid in such a manner as to bias the applied pressure to each cell substantially at the transition between linear dependence and collapsed plateau when supporting the person.

20. An adjustable cushion system according to claim 19, wherein the fluid is a gas.

21. A system according to claim 19, further including a flexible, airtight covering having an interior, the pressure system providing the fluid to the interior of the covering.

22. A system according to claim 19, wherein the pressure system provides a fluid at a pressure less than ambient pressure.

23. A system according to claim 19, wherein the pressure system provides a fluid at a pressure greater than ambient pressure.

24. A system according to claim 19, wherein the cushion includes a plurality of open foam members.

25. A system according to claim 24, wherein the pressure system provides the fluid to the plurality of open foam members.

26. A system according to claim 1 or claim 19, wherein the cushion comprises a plurality of separate open-cell foam members, each member having a flexible skin.

27. A system according to claim 26, wherein the flexible skin is airtight.

28. A method for relieving pressure on the contacting surface of a supported body of a person, the method comprising:

a. providing an adjustable cushion system comprising:

i. a cushion comprising a plurality of zones of open-cell foam, the foam exhibiting a substantially constant pressure over a specified range of compression;

ii. a pressure system for providing a fluid to the zones of open-cell foam; and iii. a controller for regulating the pressure of the fluid;

b. supporting the person on the adjustable cushion system; and c. applying a partial vacuum to a subset of the zones of open-cell foam so as to bias the foam of the subset of zones in such a manner as to exhibit substantially constant pressure in the course of supporting the person.

29. A method according to claim 28, wherein the step of applying a partial vacuum further includes supporting the body on a complementary subset of zones of open-cell foam maintained at substantially ambient pressure.

30. A method according to claim 28, wherein the step of applying a partial vacuum includes maintaining a substantially constant center of pressure with respect to the body.

31. A cushion system for supporting a body of a person, the cushion system comprising:

a. a foam member having an outside surface and a length and exhibiting substantially constant pressure over a range of compression of the member caused by providing support to the body, the range of compression corresponding to constant pressure having an onset substantially at a pressure exerted by the supported body of the person; and b. an enclosure for retaining the at least one foam member in a supporting configuration with respect to the body.

32. An adjustable cushion system for supporting a body of a person, the adjustable cushion system comprising:

a. a cushion comprising a cell, the cell having open-cell foam exhibiting a transition between a linear dependence of pressure on displacement and a collapsed plateau, the transition dependent upon applied pressure;

b. a pressure system for providing a fluid to the open-cell foam; and c. a controller for regulating the pressure of the fluid in such a manner as to bias the applied pressure to each cell substantially at the transition between linear dependence and collapsed plateau when supporting the person.

* * * * *